US009572415B2

(12) United States Patent
Durocher

(10) Patent No.: US 9,572,415 B2
(45) Date of Patent: Feb. 21, 2017

(54) HOLDING FINDING

(71) Applicant: Kathleen S. Durocher, Irvine, CA (US)

(72) Inventor: Kathleen S. Durocher, Irvine, CA (US)

( * ) Notice: Subject to any disclaimer, the term of this patent is extended or adjusted under 35 U.S.C. 154(b) by 429 days.

(21) Appl. No.: 13/775,078

(22) Filed: Feb. 22, 2013

(65) Prior Publication Data

US 2014/0237796 A1 Aug. 28, 2014

(51) Int. Cl.
*A45F 5/02* (2006.01)

(52) U.S. Cl.
CPC ..... *A45F 5/02* (2013.01); *A45F 2200/055* (2013.01); *A45F 2200/0541* (2013.01); *Y10T 24/13* (2015.01); *Y10T 29/49826* (2015.01)

(58) Field of Classification Search
CPC ... A45C 13/1069; A44D 2203/00; A45F 5/02; A45F 5/04; A45F 5/06; A45F 2200/0541; A45F 2200/055; H01F 7/023; Y10T 24/13; Y10T 24/1371; Y10T 29/49826; Y10S 224/901
See application file for complete search history.

(56) References Cited

U.S. PATENT DOCUMENTS 3,111,736 A * 11/1963 Budreck ..... A44B 15/002 24/303
3,111,737 A * 11/1963 Heil ..... A41F 1/002 24/303
3,141,216 A * 7/1964 Haskell ..... A41F 1/002 24/303
4,736,494 A * 4/1988 Marchesi ..... A41F 1/002 24/303
4,779,314 A * 10/1988 Aoki ..... A41F 1/002 24/303
5,125,134 A * 6/1992 Morita ..... A44C 5/2071 24/303
5,186,373 A * 2/1993 Taylor ..... A45F 5/02 224/183
5,842,613 A * 12/1998 White ..... A45F 5/02 206/478
5,845,369 A * 12/1998 Dunchock ..... A45F 5/02 24/103
6,260,749 B1 * 7/2001 Horovitz ..... A45F 5/02 206/5
6,632,168 B2 * 10/2003 Roberts ..... A61N 2/008 600/15
7,412,730 B2 * 8/2008 Schroeder ..... A41F 5/00 2/340
D643,212 S * 8/2011 Rathbun ..... D3/266
8,696,112 B1 * 4/2014 Vaught ..... G02C 3/02 2/10
2002/0170147 A1 * 11/2002 Heller ..... A45F 5/02 24/3.3
2009/0019671 A1 * 1/2009 Trullas ..... A45F 5/02 24/3.3

(Continued)

*Primary Examiner* — Jason L Vaughan
*Assistant Examiner* — Amanda Meneghini

(57) ABSTRACT

An article of functional jewelry includes a magnetically responsive substrate with front and back surfaces, a bend dividing the substrate into first and second substantially planar regions, and a holding device. A magnet holds the article in position by sandwiching a piece of fabric between the magnet and the substrate. The holding device may include an aperture penetrating the first region forming a loop that supports an object such as a pair of eyeglasses or a scarf.

16 Claims, 5 Drawing Sheets

(56) References Cited

U.S. PATENT DOCUMENTS

| | | | | |
|---|---|---|---|---|
| 2010/0083699 | A1* | 4/2010 | Conigliaro | A44C 15/003 63/1.18 |
| 2010/0269239 | A1* | 10/2010 | Kulp et al. | A41D 27/08 2/69 |
| 2011/0083254 | A1* | 4/2011 | Trutna | A41F 1/002 2/326 |
| 2015/0223588 | A1* | 8/2015 | DeNittis | A45F 5/004 24/298 |
| 2016/0007722 | A1* | 1/2016 | Macon | A41F 1/002 2/426 |

* cited by examiner

HOLDING FINDING

BACKGROUND OF THE INVENTION

Field

This invention is in the field of functional jewelry. In particular, it concerns a jewelry finding including holding features.

Background

Many useful items are used so frequently that people keep them close at hand. Some items may be conveniently disposed about the body, such as eyeglasses perched atop the head or a pencil carried behind an ear. Items may also be carried in pockets, in purses, on chains about the neck, or by hand. However these methods may be unsightly, difficult to access, susceptible to loss, or cause damage to clothing.

U.S. Pat. No. 6,260,749 to Horovitz entitled Small Article Holder Including Magnet Means, the disclosure of which is herein incorporated by reference, describes a variety of devices to support eyeglasses about the body. Horovitz further discloses his own invention of an eyeglass holder fastened to a section of fabric magnetically. The holder is described as a decorative base member with a ring secured to the base member. Another embodiment discloses a hook depending from the decorative base member. The base member is described and illustrated as a flat body attached to a disk on the rear surface. The disk and a separate magnet hold the device to an article of clothing. While this device may be satisfactory for some applications, it is difficult to insert and remove items from a flat device attached to fabric without risk to the item or the fabric. Further, a particular decorative base member may appeal to some but not others.

Thus there remains a need for a jewelry finding that may support a decorative setting, that adheres magnetically to clothing or other fabrics, and that provides a convenient and safe holding device that retains commonly used articles.

SUMMARY

My invention includes a finding that is capable of supporting and holding a useful object such as a pen, nametag, or reading glasses. The object may be readily removed and reinserted as needed. The finding may be magnetically attached to clothing or other fabric without damaging the fabric and without visible fastenings. The finding is also configured to support an ornament more permanently affixed. In some embodiments, the finding includes an attachment segment and a holder segment. Both segments are substantially planar and connect to one another at a bend line. The two segments may be disposed at a defined angle to one another. The holder segment includes a holding device that may be an elongated hole perforating the holder segment. The attachment segment includes a front surface treated to aid in adhering an ornament. The attachment segment is made of magnetic material. A separate magnet attaches to the back of the attachment segment sandwiching a section of fabric to hold the finding in place. The back surface of the attachment segment may be roughened to increase friction holding the finding in place.

DETAILED DESCRIPTION

Figure 2A:
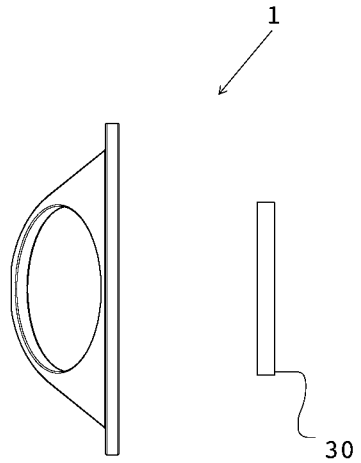
FIG. 2*a* illustrates a top view of the same embodiment.
Figure 1:
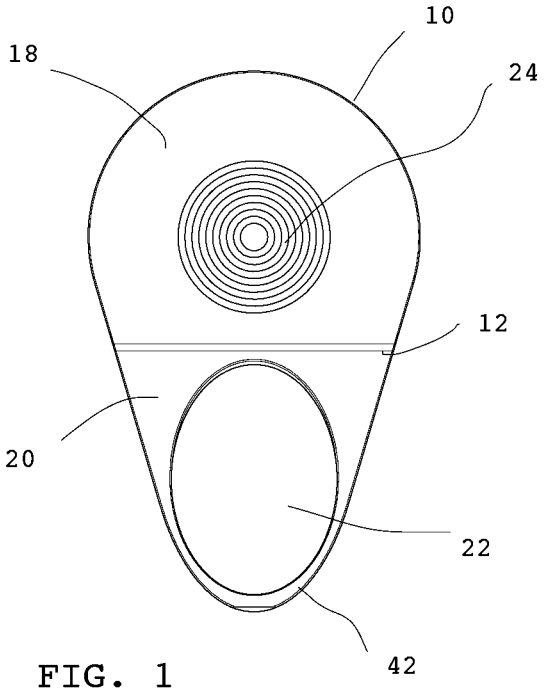
FIG. 1 illustrates a front view of an embodiment of the finding of my invention.
Figure 2B:
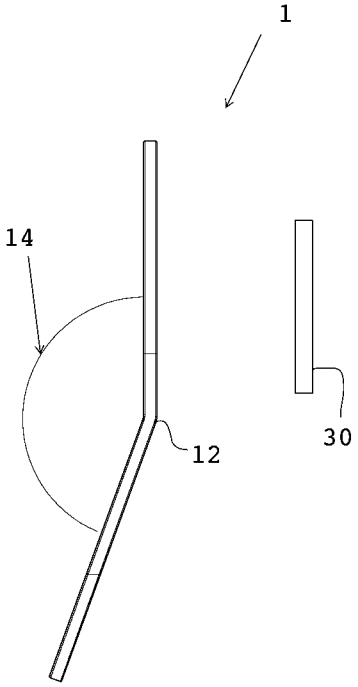
FIG. 2*b* illustrates a top view of the same embodiment.
Figure 3:
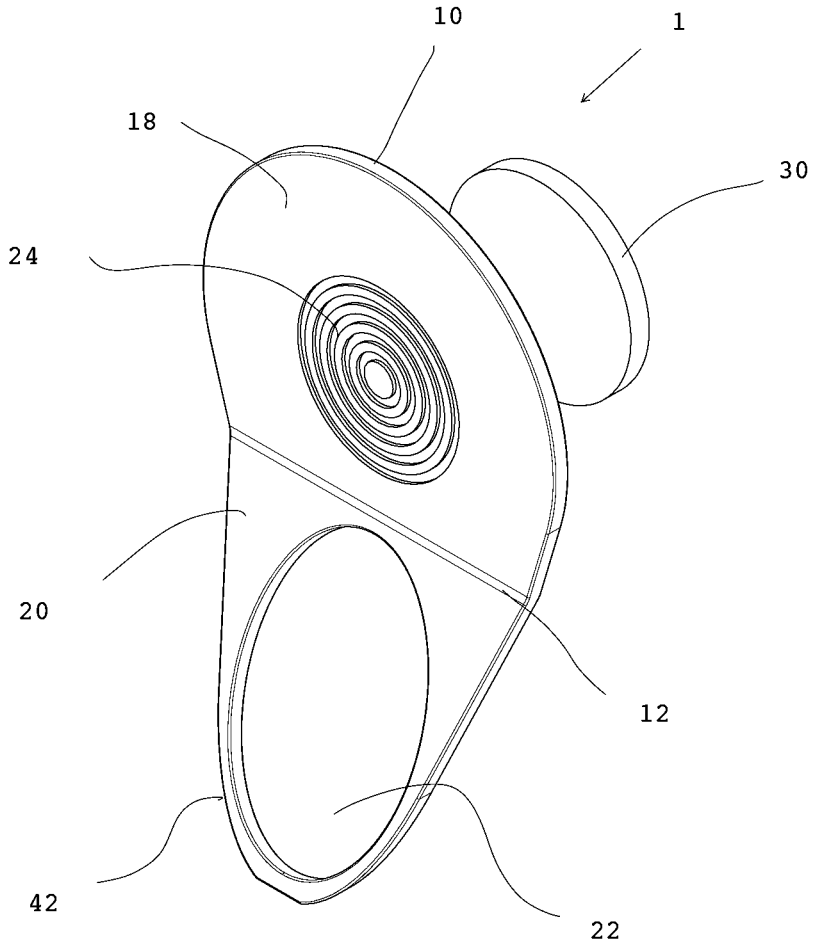
FIG. 3 illustrates a perspective view of the same embodiment.
Figure 4A:
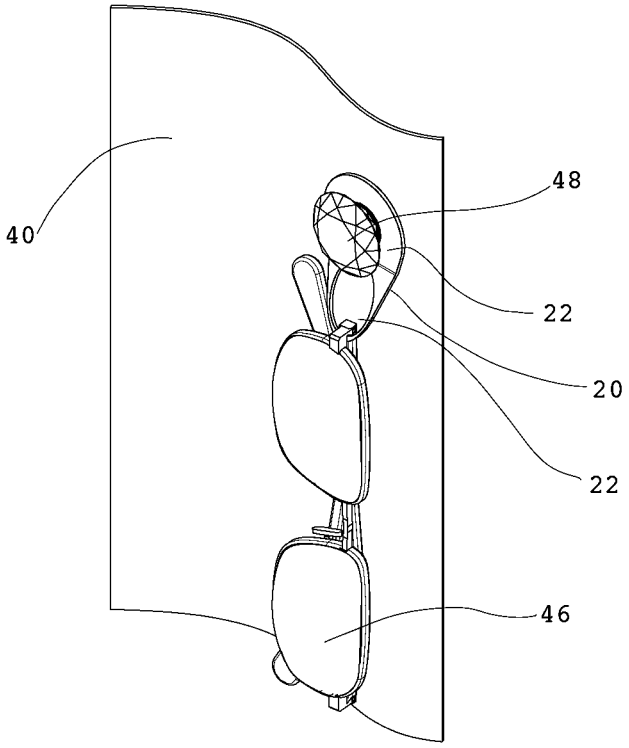
FIGS. 4*a* and 4*b* illustrates the same embodiment applied to a section of fabric and supporting a pair of eyeglasses and including an applied ornament.
Figure 4B:
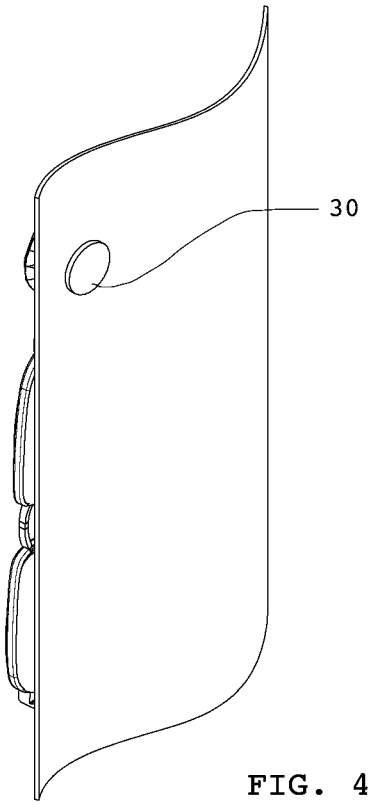

FIGS. 1-4*b* illustrate different views of the same embodiment of the finding 1. The embodiment includes a bent flat body that is thin relative to its diameter. The body may be composed of a sheet of magnetic material, such as plated steel. This embodiment includes two parts, a keeper 10 and a retainer 30. FIGS. 2-3 show retainer 30 with exaggerated separation from keeper 10 for clarity. In use, as illustrated in FIGS. 4*a* and 4*b*, the two parts may be disposed on either side of a section of fabric and held together by magnetic attraction between keeper 10 and retainer 30. The effect of this is to frictionally hold the keeper and retainer in a fixed position with respect to the fabric. Once held in a fixed position, the keeper can support and removably hold useful items such as glasses, pens, timepieces, flowers, keys, nametags, or the like. The keeper may also be bonded to and display ornamental items such as jewels, beadwork, badges, charms, and the like.

The keeper includes two substantially planar bodies connected to one another along a bend line 12 and disposed at a relative angle 14. Such a structure may be formed, for example, by a simple bend of a planar substrate, such as sheet metal, along a bend line. Bend line 12 divides the part into two planar regions, with each region disposed at an angle with respect to the other. In some embodiments, the two planar regions may be substantially symmetrical about respective midlines. The respective midlines may meet at the bend line such that the entire finding is substantially symmetrical about the plane containing the conjoined midlines Two planar bodies may be disposed at any angle with respect to each other. The angle between such bodies may be measured in either direction on the common reference plane. A first direction of measurement yields an angle less than 180 degrees. The second direction of measurement yields an angle more than 180 degrees. The sum of the two angles is 360 degrees. Such angles are occasionally referred to as explementary angles.

In this document, two surfaces are said to face toward each other if the surfaces are disposed at an angle with respect to one another and the angle between the surfaces is less than 180 degrees. Conversely, two surfaces are said to face away if the surfaces are disposed at an angle with respect to one another and the angle between the surfaces is greater than 180 degrees. The purpose of this convention is to clearly identify the relationship of surfaces within the device.

The two substantially planar portions of the keeper may be identified as an attachment segment 18 and a holder segment 20. Attachment segment 18 cooperates with retainer 30 to affix the keeper to a section of fabric. Holder segment 20 includes a holding device 22 to support and removably hold useful items. Each of attachment segment 18 and holder segment 20 has substantially parallel front and back surfaces. The back surface of attachment segment 18 continues as the back surface of holder segment 20 and the front surface of attachment segment 18 continues as the front surface of holder segment 20. The front surface of attachment segment 18 faces toward the front surface of holder segment 20.

Angle 14 between attachment segment 18 and holder segment 20 is selected to support the item carried by holding device 22 and to permit easy attachment and removal of the item without snagging or catching. I have found that certain angles provide benefits not provided by other angles and that these beneficial angles are intimately related to the conformation of the entire finding. While the finding may be oriented in any direction, an orientation with attachment segment 18 positioned above holder segment 20 is useful to both hold useful items and to display decorative items. In such an orientation, the weight of supported items may drag the holder portion of the finding downward. With angles of less than about 130 degrees and with common items such as reading glasses, the entire finding may pivot about the bend line 12 causing the attachment segment 18 to jut outward and the holding segment 20 to retreat toward the fabric. This change in position makes removal of the item difficult and cause an unsightly "sag" in the fabric supporting the keeper. The change in position may also interfere with viewing of decorative items affixed to the attachment segment.

Angles greater than about 175 degrees may make insertion and removal of the held items difficult. Angles between about 130 degrees and about 175 degrees are thus desirable. In some configurations, a narrower range of angles improves the appearance of keeper 10 when positioned on a section of fabric, particularly a fabric section near an open edge, such as adjacent the top of a pocket or a lapel. Angles between about 150 degrees and about 170 degrees are desirable in such configurations. Even narrower ranges of angles, such as about 160 degrees are appropriate for particular supported items such as reading glasses. Use of the term "about" here means within a few degrees of the stated angles.

As discussed above, keeper 10 may support and removably hold useful items such as glasses, pens, timepieces, flowers, nametags, scarves, or the like. Holder segment 20 of keeper 10 includes holding device 22. Holding devices 22 may be simple geometrical extension of holder segment 20, such as a hole, a tie, a cleat, a peg, a notch, a boss, or a hook. More complex holding devices include spring retainers, magnets, clips (such as alligator style clips), or pins.

In some embodiments, including that illustrated in FIG. 1, holding device 22 is a hole piercing holder segment 20. The hole includes smooth contours that allow easy loading and unloading of the supported item. Useful shapes for such a hole are circles, ellipses, and polygons, particularly polygons with rounded corners. Some of these shapes, such as ellipses and ovals, have larger major axes and smaller minor axes. The major axis of the hole may be advantageously oriented perpendicularly to the edge of the holder segment shared with the attachment segment (the bend line). This orientation makes it easier to insert items when the keeper is affixed to a segment of fabric such as a garment.

In some embodiments, holder segment 20 may include an elongated hole positioned such that the long axis of the hole is coincident with the midline of holder segment 20. The midline of holder segment 20 may coincide with the extension of the midline of the attachment segment 18, and each of the segments may be symmetrical with respect to the midline. This advantageously presents a pleasing shape as well as providing a finding that may be conveniently mounted in a variety of orientations to the fabric or clothing.

A hole in holder segment 20 may dominate that segment to the extent that the holder segment surrounding and defining the hole is relatively narrow with respect to the size of the hole. In some cases, portions of holder segment 20 surrounding the hole form a border or rim that may have extent similarly sized to the thickness of the material. This is particularly useful surrounding portions of the hole distant from the bend line. This arrangement makes it easier to insert and remove hinged objects, such as reading glasses, to and from the hole. The embodiment of FIGS. 1-4 includes a narrow rim 42 surrounding the lower aspect of the hole.

In embodiments including an elongated hole, the hole may be sized to fit items to be carried. I have found that hole type holder devices fit a variety of useful items if the holes have major axis between about 0.5 inches and about 1.0 inches and the ratio of the minor axis of the aperture to the major axis is about 0.5 to about 1.0. An elliptical hole measuring about 0.7 inches end-to-end and about 0.4 inches side-to-side allows easy insertion and removal of reading glasses when the angle between the holder segment and the attachment segment is about 160 degrees.

As discussed above, the keeper may display decorative items such as jewels, beadwork, badges, charms, and the like. Such decorative items may be permanently or temporarily affixed to the front surface of the keeper using adhesives, welds, screws, rivets, clips, or other fastening methods. I have found that adhesives, such as epoxy adhesives, are of particular benefit because of their bonding versatility, strength, and ease of use. However, such adhesives bond poorly to relatively smooth substrates.

The keeper 10 may be of generally smooth finish to avoid snagging fabrics or damaging held items during insertion, removal, or carriage. This smooth finish, while desirable for these reasons, lessens the adherence of adhesives. In some embodiments, the keeper includes a portion 24 of roughened texture to promote adhesion. This roughened texture may be limited to areas of the keeper where adhesives may be applied. In many applications, the roughened texture is confined to the central region of the front face of attachment segment 18.

In this document, a portion of a surface has roughened texture if its surface area is greater than twice that of an equivalently disposed plane and if the local excursions from flatness are greater than five percent of the material thickness. Such roughened surface may be created, for example, by coining, stamping, etching, punching, scribing, or abrading the material of the keeper.

In this document, substantially planar includes planar structures and shallow curves. A shallowly curved keeper may be substantially planar if it may be held in place by a planar magnetic retainer of smaller facial area than the keeper, and if its concavity or convexity does not deviate from planarity by more than about five times the material thickness of the keeper.

The shape and size of the attachment segment may vary, but should be at least comparable in area to the retainer so as to maximize the force between retainer and keeper. A larger size also provides more surface area for attachment of ornamental items. However, the attachment segment should be kept relatively small so that it does not protrude from attached ornamental items mounted to it. One suitable shape for the attachment segment is roughly rectangular, with rounded corners to prevent snags. Round shapes may also be suitable as they reduce the possibility of protruding corners while matching the outline of commonly available magnets. The attachment segment may range between about one-half inch to about one and one-half inch across. In some embodiments, the shape may be an ellipse or an oval, each of which provides a smooth contour.

The shape and size of the holder segment may also vary but generally conforms to smoothly connect the attachment segment to the holding device. In cases where the holding device is a hole, the holder segment may extend from the bend line between one-eighth inch and one-half inch more than the size of the hole. The edges of the keeper may be rounded or radiused to prevent snags.

The keeper may be composed of a monolithic piece of material, such as sheet metal. Appropriate materials include pure metals, alloys, and composites that are susceptible to magnetic attraction, particularly ferromagnetic materials. Such materials include iron and its alloys, such as various magnetic steels, including mild steel sheet stock. Steels have the additional benefits of wide availability at low cost, easy formability, and high mechanical strength. Some common steels are subject to corrosion by oxidation. This can be prevented by plating or coating the finished finding with an anticorrosion coating. Suitable anticorrosion coatings resist oxidation, support adhesion of decorative items by gluing, and have an attractive finish. Acceptable anticorrosion coatings include, for example, chrome or nickel plating, epoxy paints, and conductive polymers. Alternatively, the keeper portion may be composed of a corrosion-resistant metal or alloy, such as a magnetic stainless steel.

Material thickness depends upon strength and magnetic properties. Mild steel sheet between 0.018 inches and 0.067 inches thick (26 to 13 gauge) is suitable for most applications.

The retainer comprises a magnet separable from the keeper. Suitable magnets provide high binding strength at low weight and size. Appropriate magnets include nickel-plated neodymium iron boron magnets sized to fit the particular keeper. Useful sizes for disk magnets range from about one-half inch diameter to about one and one-half inch diameter. Other shapes, such as rectangular magnets may also serve. Thinner magnets, 1/16 inch to 1/4 inch thick provide good holding strength without protruding too far from the back of the retained fabric while in use. A suitable magnet may be about 1/8 inch thick. A variety of such magnets are commercially available, including those sold by K&J Magnetics, Inc. of Jamison, Pa. One suitable magnet is K&J part number DAH1 5/8 inch diameter×1/10 inch thick grade N42 nickel-plated axially magnetized neodymium iron boron disk magnet.

Some fabrics are very smooth so that even a strong force between retainer and keeper is insufficient to prevent the finding from sliding down the fabric. In some embodiments, the back surface of the keeper or a surface of the retainer, or both may include a roughened region (not shown but disposed, for example, on the rear surface opposite portion 24) to increase friction between the finding and the fabric. Such a roughened region may be formed in the same manner as portion 24, for example, by coining, stamping, etching, punching, scribing, or abrading the material of the keeper or retainer.

FIG. 4 shows the same embodiment disposed on a section of fabric 40, supporting a pair of eyeglasses 46, and including an applied ornament 48. FIG. 4*a* shows a front perspective view. The attachment segment is partially hidden from view by ornament 48 applied to the face of attachment segment 18. FIG. 4*b* shows a rear perspective illustrating the position of round magnetic retainer 30 on the distal side of fabric 40. The folded temple piece of eyeglasses 46 inserts through holding device 22.

To use the finding to support an object such as the illustrated eyeglasses, the user places a section of fabric between the back surface of the keeper and the retainer. Friction between the fabric and the keeper holds the finding and its attached ornament in place. The user then inserts a portion of the object, such as one temple piece of the folded eyeglasses, through the loop formed by holding device 22. The angle between the attachment segment and the holding segment makes it simple to insert and remove the eyeglasses as needed.

The finding may also support other objects. It is also suitable for anchoring a scarf or shawl to another item of clothing. The user threads a portion of the scarf through the loop and places a section of fabric from the item of clothing between the keeper and the retainer. This serves to keep in place a scarf that otherwise may move to an undesired position. The portion of the scarf threaded through the loop can be one free end, both free ends, or a corner of the scarf. When two free ends are threaded through the holder, these may be threaded in the same direction (for example, entering from the front surface and exiting the back surface) or in opposite directions from one another. This latter method is particular appropriate when the keeper and retainer are placed on the shoulder portion of a garment. When so placed, one end of the scarf may be draped toward the front of the garment and the other end draped toward the back of the garment giving a pleasing appearance. Alternatively, the user may push a midsection of the scarf into the loop. The pushed-through section may be adjusted in length to drape the scarf as the best fits the user's desires. Friction between the inserted section of the scarf and the loop can hold the scarf in position. The friction may be adjusted by pushing greater or lesser portions into the loop or by pushing through more than one section of the scarf.

In embodiments for anchoring a scarf or shawl, the hole may be larger than that best suited for supporting other objects. Holes in such embodiments may range from about 3/4" to about 1 1/8" in diameter to permit easy insertion and removal while retaining sufficient friction to hold the scarf.

Figure 5:
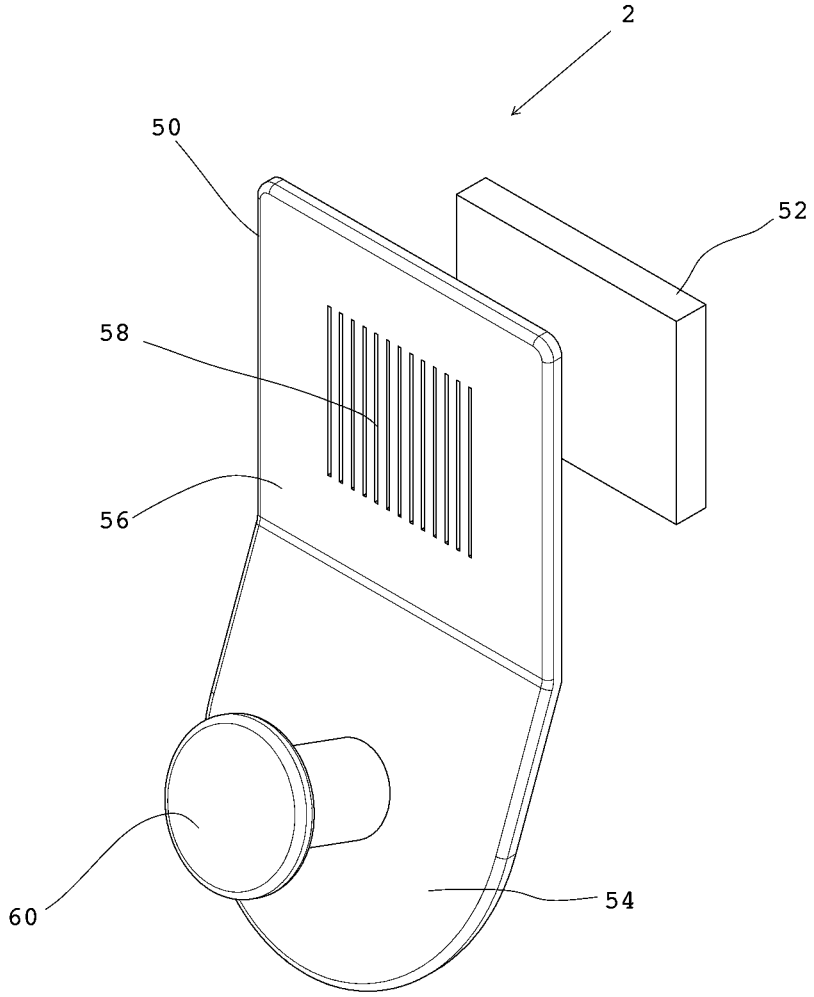
FIG. 5 illustrates a second embodiment of the finding of my invention.

FIG. 5 shows a front perspective view of second embodiment of finding 2 including keeper 50 and magnetic retainer 52 (shown with exaggerated separation for clarity). Keeper 50 comprises a rectangular attachment segment 56 and a rounded holder segment 54. Holder segment 54 has holding device 60 comprising a flanged stud. The roughened area 58 of attachment segment 56 includes straight parallel lines, illustrating that the roughened texture can take any number of forms. Magnetic retainer 52 is in this embodiment rectangular to increase overlap, and hence retention strength, with keeper 50.

Figure 6A:
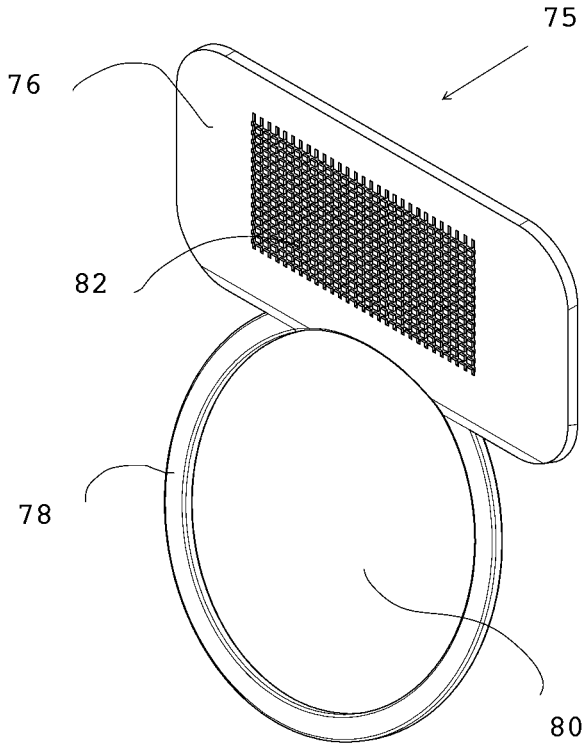
FIGS. 6*a* and 6*b* illustrates a third embodiment of a portion of the finding of my invention.
Figure 6B:
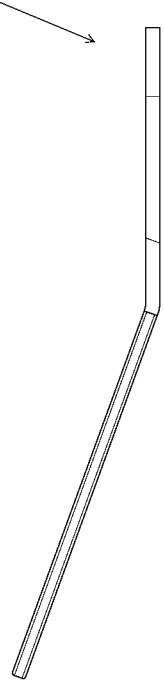

FIGS. 6*a* and 6*s* show front perspective and side views of a third embodiment of a keeper 75. This embodiment comprises a rectangular attachment segment 76 and a rounded holder segment 78. Holder segment 78 includes a hole 80 that takes up most of holder segment 78 and extends partly into attachment segment 76. Holder segment 78 surrounding hole 80 forms a border or rim with extent similarly sized to the thickness of the material. Keepers of this form are particularly advantageous for securing larger objects such as scarves or the like because only a relatively small portion of holder segment 78 is visible once a scarf is inserted. Smaller visible portions may avoid detracting from the appearance of the deployed scarf. The edged of keeper 75, particularly the edges of holder segment 78 surrounding hole 80, may be rounded to avoid snagging a scarf during insertion and removal. The roughened area 82 of attachment segment 76 includes crossed line knurling, again illustrating that the roughened texture can take any number of forms.

Some embodiments (not shown) may include a holder segment having stiff wire formed into a planar holding loop and adhered to the attachment segment by, for example, adhesive, soldering, or welding. Other embodiments (not shown) may include a holder segment connected to an attachment segment without a bend between them.

The features disclosed above may be combined with one another even though sometimes described with reference to different embodiments. Still other embodiments will be apparent without departing from the basic scope of my invention. I intend the scope of the appended claims to encompass such alternative embodiments.

I claim:

1. A method of securing an object to a section of fabric, the method comprising:

providing an article of functional jewelry, the article comprising:

a keeper including:

an attachment segment having a first planar substrate including opposed first front and first back surfaces and a first edge, the first substrate including a magnetically responsive material;

a holder segment having a second planar substrate including opposed second front and second back surfaces and an elongated aperture, the holder segment joined to the attachment segment along the first edge, the second substrate disposed at an angle to the first substrate, and the major axis of the aperture disposed perpendicularly to the first edge; and a retainer magnetically coupled to the keeper;

inserting a portion of the object through the aperture; and placing the section of fabric between the back surface and the retainer.

2. The method of claim 1, wherein the second substrate forms a monolithic extension of the first substrate.

3. The method of claim 1, wherein the first front surface is disposed toward the second front surface, the first front surface having an area of roughened textured.

4. The method of claim 1, wherein the aperture includes an ellipse, an oval, or a polygon with rounded corners.

5. The method of claim 4, wherein the major axis of the aperture measures between about 0.5 inches and about 1.125 inches and the ratio of the minor axis of the aperture to the major axis is about 0.5 to about 1.0.

6. The method of claim 5, wherein the aperture is disposed along the midline of the second substrate.

7. The method of claim 6, wherein the midline of the first substrate intersects the midline of the second substrate at the first edge.

8. The method of claim 1, wherein the retainer is smaller in extent than the first substrate.

9. The method of claim 1, wherein the angle is between about 130 degrees and about 175 degrees.

10. The method of claim 9, wherein the angle is about 160 degrees.

11. The method of claim 1, wherein the article further comprises an ornament and the method further comprises affixing the ornament to the first front surface.

12. The method of claim 1, wherein the object is a scarf, wherein the section of fabric is a portion of a garment, and wherein the step of inserting a portion of the object through the aperture includes threading one of a free end of the scarf or a fold of the scarf through the aperture.

13. The method of claim 12, wherein the object is a scarf, and wherein the section of fabric is disposed near the shoulder portion of a garment, and wherein the step of inserting a portion of the object through the aperture includes threading a first free end of the scarf through the aperture from the front surface and a second free end of the scarf through the aperture from the back surface, the method further comprising draping the first free end of the scarf toward the front of the garment and the second free end of the scarf toward the back of the garment.

14. A method of securing an object to a section of fabric, the method comprising:

providing an article of functional jewelry, the article comprising:

a keeper including:

a magnetically susceptible substrate including front and back surfaces;

a bend dividing the substrate into first and second regions, the first region and the second region substantially planar; and an aperture penetrating the substrate in the first region, wherein the first region includes a border surrounding a portion of the aperture, the width of the border less than about twice the thickness of the substrate a retainer magnetically coupled to the keeper;

inserting a portion of the object through the aperture; and placing the section of fabric between the back surface and the retainer.

15. The method of claim 14, wherein the front surface of the first area has a smooth texture and the front surface in the second region has a rough texture.

16. The method of claim 14, further comprising a retainer magnetically coupled to the back surface, the retainer smaller in area and extent than the second region, wherein at least one of the back surface and the retainer has an area of roughened texture.

* * * * *